US005280769A

United States Patent [19]

Yates

[11] Patent Number: 5,280,769

[45] Date of Patent: Jan. 25, 1994

[54] PRESSURE RELIEF MEANS FOR INDUCTION SYSTEM

[75] Inventor: Christopher J. Yates, Rochester, N.Y.

[73] Assignee: General Motors Corporation, Detroit, Mich.

[21] Appl. No.: 55,879

[22] Filed: May 4, 1993

[51] Int. Cl.[5] ..... F02M 35/00; B65D 51/16

[52] U.S. Cl. ..... 123/52 MF; 277/29; 277/235 B

[58] Field of Search ..... 123/52 M, 52 MC, 52 MP; 277/29, 235 B

[56] References Cited

U.S. PATENT DOCUMENTS

| | | | |
|---|---|---|---|
| 3,782,343 | 1/1974 | Notaras et al. | 123/52 M |
| 3,930,656 | 1/1976 | Jelinek | 277/235 B |
| 4,889,081 | 12/1989 | Ozaki | 123/52 M |
| 5,003,933 | 4/1991 | Rush, II et al. | 123/52 MC |
| 5,009,199 | 4/1991 | MacFarlane | 123/52 MF |
| 5,100,157 | 3/1992 | Chabala | 277/29 |
| 5,150,669 | 9/1992 | Rush, II et al. | 123/52 MF |

*Primary Examiner*—Tony M. Argenbright
*Assistant Examiner*—M. Macy
*Attorney, Agent, or Firm*—Karl F. Barr, Jr.

[57] ABSTRACT

The present invention discloses a means for limiting the pressure within the induction system of an internal combustion engine having a flexible elastomeric sealing wall disposed between components of the intake. When internal pressures reach a predetermined limit, the wall is subject to elastic deformation to thereby vent the pressure increase within the induction system to the exterior thereof. Rates of pressure rise and peak pressures are thereby lowered. Return of normal system pressure levels operate to reseat the sealing wall enabling continuation of engine operation.

6 Claims, 2 Drawing Sheets

PRESSURE RELIEF MEANS FOR INDUCTION SYSTEM

TECHNICAL FIELD

The invention relates to a pressure relief means and, more particularly, to a pressure relieving induction system gasket member for an internal combustion engine.

BACKGROUND

The induction systems of internal combustion engines typically employ intake manifolds of varying size and complexity to deliver air and fuel to associated combustion chambers. During engine operation, the intake may experience periods of high pressure which may necessitate the provision of a venting or control device when pressure levels reach a predetermined limit. Such control devices may take the form of valves which open to atmosphere during the pressure event or flexible retaining clips operable to allow separation of intake components to vent pressure therebetween. Examples of such devices are described in U.S. Pat. No. 5,150,669 issued Sep. 29,1992 to Rush, II et al.

The means for limiting the pressure within the intake heretofore described require the modification of the intake manifold to accommodate the addition of a valve member or the use of flexible retainers. Additionally, use of such devices results in the proliferation of parts and assembly operations with concurrent cost, serviceability and durability penalties.

SUMMARY OF THE INVENTION

The present invention relates to a pressure relieving gasket means for use in the induction system of an internal combustion engine. The gasket includes a carrier member constructed as a semi-rigid, continuous flat strip which is configured to be disposed between two members of an engine induction system such as upper and lower intake manifold housing members or, alternately, the throttle body assembly and the intake manifold. The carrier has a flexible ribbon of gasket material disposed on opposing faces for sealing engagement with sealing surfaces of the induction system components. Raised lands positioned at locations about the carrier member act as compressive stops to limit compression of the gasket ribbon to a predetermined value with the result that a portion of the gasket ribbon defines a flexible barrier which is exposed to the inner volume of the intake system and to atmosphere. Pressure within the intake manifold which exceeds a predetermined value is vented by deformation of the flexible barrier of exposed gasket ribbon. Upon return of the manifold pressure to normal values, the gasket ribbon returns to a sealing position under the influence of manifold vacuum thereby minimizing introduction of unmetered air into the induction system and allowing continued operation of the internal combustion engine.

Other objects and features of the invention will become apparent by reference to the following description and to the drawings.

DECSRIPTION OF THE PREFERRED EMBODIMENT

Figure 1:
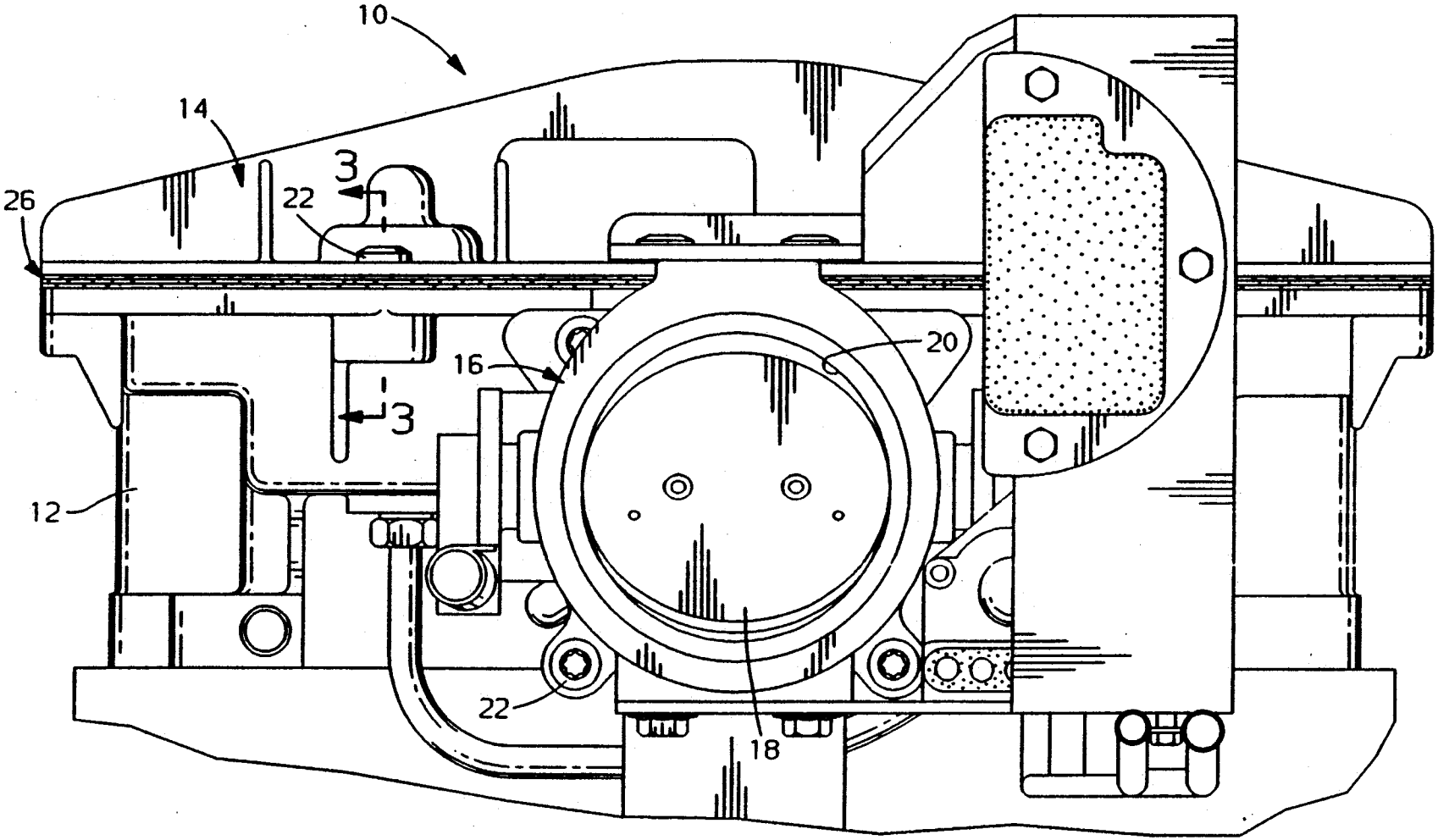
FIG. 1 is a front elevational view of an intake manifold for an internal combustion engine embodying the present invention.

Referring to FIG. 1, an internal combustion engine includes and induction system comprising an intake manifold 10 into which precise quantities of air of fuel are metered. The intake manifold of FIG. 1 comprises a lower manifold housing 12 and an upper housing or cover 14. Air is metered into the intake manifold through a throttle body assembly 16 having a throttle plate 18 rotatably disposed within a throttle bore 20 for metering air flow. The throttle body assembly 16 and the cover 14 are mounted to the lower manifold housing 12 through the use of bolts 22 or other suitable means engaged in through holes 24, and typically employ sealing members such as cover gasket 26 to prevent unmetered air from entering the intake downstream of the throttle plate 18.

Figure 2:
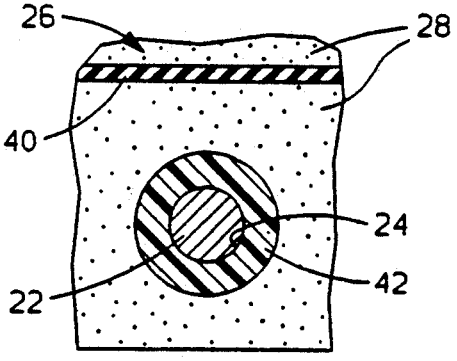
FIG. 2 is a sectional view taken generally along line 2—2 of FIG. 3.
Figure 3:
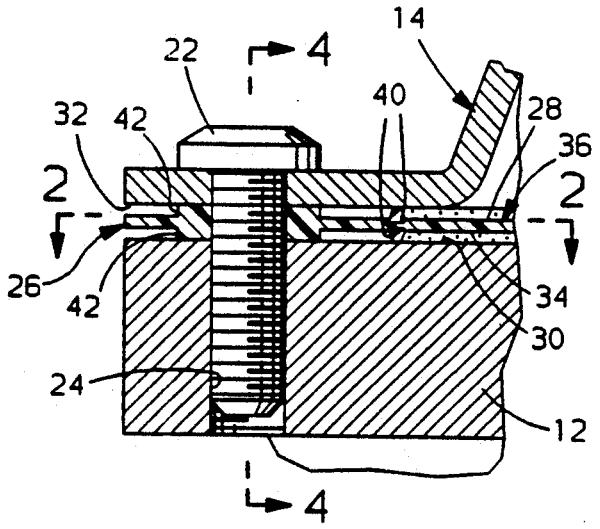
FIG. 3 is a sectional view taken generally along line 3—3 of FIG. 1.
Figure 4:
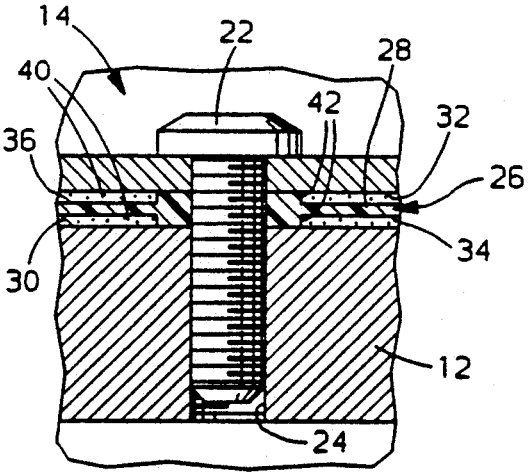
FIG. 4 is a sectional view taken generally along line 4—4 of FIG. 3.
Figure 5A:
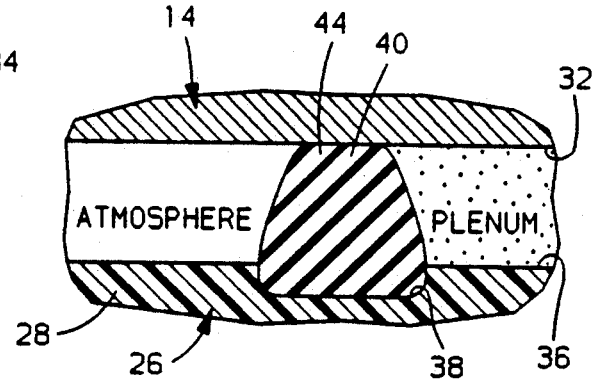
FIGS. 5*a*, 5*b*, and 5*c* are views taken through an elastomeric wall of the present invention which illustrate the operation of the wall.

A typical gasket member embodying the present invention is illustrated in FIGS. 2, 3 and 4 and comprises a semi-rigid carrier member 28 configured as a flat strip having dimensions corresponding to those of the flange surfaces 30, 32 to be sealingly joined. The carrier member 28 may be constructed of glass reinforced nylon or any other material demonstrating suitable compressive strength. Each face 34, 36 of the carrier member has a carrier groove 38, FIGS. 5*a*–5*c*, along its entire length for receiving a resilient gasket ribbon 40 therein. The gasket ribbons 40 extend outwardly from the respective faces 34, 36 of the carrier member 28 so that when disposed between flange sealing surfaces 30, 32 of the cover 14 and lower case 12, they are compressed, FIG. 5*a*, to provide a seal therebetween.

Figure 5B:
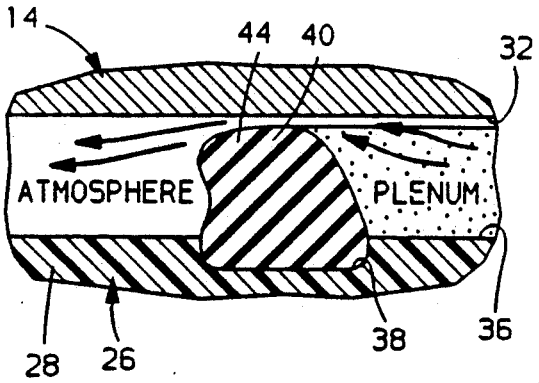
Figure 5C:
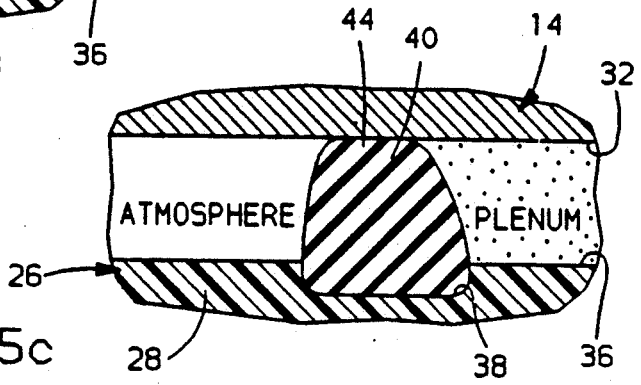

In a preferred embodiment, raised lands 42 are molded into the carrier member 28 at locations corresponding to the attaching bolt through holes 24 of cover 14 and lower case 12. The lands 42 support the bolt clamp load and act to limit the compression of the gasket ribbons 40 to thereby establish elastomeric walls 44 extending between the vacuum biased manifold plenum and the exterior of the manifold. During normal engine operation, the elastomeric walls 44 define a sealing interface between atmospheric pressure on the exterior of the manifold housing and vacuum on the interior thereof. Should plenum pressure increase beyond a predetermined limit, the elastomeric walls 44 are deformed outwardly, as illustrated in FIG. 5*b*, providing a leak path of large area that rapidly reduces the rate of pressure rise and peak pressures within the induction system. Return of system pressure to normal levels will re-seat the elastomeric wall 44, FIG. 5*c*, minimizing the intrusion of unmetered air into the intake manifold 10 downstream of throttle valve 18 thereby allowing continued operation of the engine.

The above disclosed preferred embodiment may be modified to include raised lands at locations other than those surrounding the bolt through holes 24 should such placement provide a more uniform application of the bolt clamping force. In addition it should be recognized that the compression limiting lands may be cast into the surfaces 30, 32 of the cover 14 and housing 12 rather than into the surface of the carrier member 28. In such a case, it may be desirable to dispose with the carrier member 28 and utilize a flexible sealing member disposed within carrier grooves cast into the sealing surfaces 30, 32.

The present invention discloses a means for limiting the pressure within the induction system of an internal combustion engine having a flexible elastomeric sealing wall subject to elastic deformation, when internal pressures reach a predetermined limit, to thereby reduce the rate of pressure rise and lower peak pressure by establishing a large area leakage path. Return of normal system pressure levels operate to reseat the sealing wall to thereby enable continuation of engine operation.

The foregoing description of the preferred embodiment of the invention has been presented for the purpose of illustration and description. It is not intended to be exhaustive, nor is it intended to limit the scope of the invention to the precise form disclosed. It will be apparent to those skilled in the art that the disclosed embodiments may be modified in light of the above teachings. The embodiments described were chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

The embodiments of the invention in which an exclusive property or privilege is claimed are defined as follows:

1. An induction system for an internal combustion engine comprising first and second members joined along opposed sealing surfaces to define an enclosed chamber, a resilient sealing member disposed within a locating groove between said sealing surfaces, and compression limiting means disposed between said opposed sealing surfaces to define a space therebetween, said space and said sealing member defining an elastomeric sealing wall extending between said enclosed chamber and the exterior of said induction system, said sealing wall operable to deform elastically under a predetermined pressure differential thereacross, to limit said pressure differential to a predetermined value.

2. An induction system for an internal combustion engine comprising first and second members joined along opposed sealing surfaces to define an enclosed chamber, a carrier member disposed between said sealing surfaces, having a resilient gasket member disposed on each face thereof for sealing engagement with said opposed sealing surfaces and compression limiting means extending from a face of said carrier member to define a space between said face of said carrier member and said sealing surface, said space and one of said resilient gasket members defining an elastomeric sealing wall between said enclosed chamber and the exterior of said induction system, said elastomeric sealing wall operable to deform elastically under a predetermined pressure differential thereacross, to limit said pressure differential to a predetermined value.

3. An induction system for an internal combustion engine, as defined in claim 2, said elastomeric sealing wall operable to return to a sealed position in said space between said carrier member and said sealing surface following said elastic deformation.

4. An induction system for an internal combustion engine comprising first and second members joined along opposed sealing surfaces to define an enclosed chamber, a semi-rigid carrier member disposed between said sealing surfaces, having a resilient gasket member disposed in a carrier groove on each side thereof for sealing engagement with said opposed sealing surfaces and compression limiting means extending from said carrier member to define a space between each side of said carrier member and said sealing surfaces, said spaces and said resilient gasket members difining elastomeric sealing walls between said enclosed chamber and the exterior of said induction system, said sealing wall operable to deform elastically under a predetermined pressure differential thereacross, to limit said pressure differential to a predetermined value.

5. An induction system for an internal combustion engine, as defined in claim 4, said elastomeric sealing walls operable to return to a sealed position in said space between said carrier member and said sealing surfaces following said elastic deformation.

6. A pressure relief means for use between a first and a second member of an induction system in an internal combustion engine comprising a carrier member having first and second faces with a resilient sealing member disposed thereon and lands extending therefrom, said carrier disposable between said first and second induction system members wherein said resilient sealing member defines a sealing interface and said lands define an elastomeric sealing wall between the interior and the exterior of the induction system by limiting compression of said gasket member to a predetermined value, said sealing wall operable to deform elastically under a predetermined pressure differential thereacross, to limit said pressure differential to said predetermined value.

* * * * *